US008479928B2

(12) United States Patent
Tanabe et al.

(10) Patent No.: US 8,479,928 B2
(45) Date of Patent: Jul. 9, 2013

(54) COLLAPSIBLE EQUIPMENT RACK

(75) Inventors: Tammy L. Y. Tanabe, Kaneohe, HI (US); Todd A. Tanabe, Kaneohe, HI (US); Carl S. Tanabe, Kaneohe, HI (US); Toni L. Tanabe, Kaneohe, HI (US)

(73) Assignee: Tammy L. Y. Tanabe, Kaneohe, HI (US)

( * ) Notice: Subject to any disclaimer, the term of this patent is extended or adjusted under 35 U.S.C. 154(b) by 0 days.

(21) Appl. No.: 13/439,363

(22) Filed: Apr. 4, 2012

(65) Prior Publication Data

US 2012/0248047 A1 Oct. 4, 2012

Related U.S. Application Data

(60) Provisional application No. 61/516,622, filed on Apr. 4, 2011.

(51) Int. Cl.

| | |
|---|---|
| ***A47F 7/00*** | (2006.01) |
| *A47B 43/00* | (2006.01) |
| *A47B 47/00* | (2006.01) |

(52) U.S. Cl.

USPC ..... 211/64; 211/186; 211/198

(58) Field of Classification Search

USPC ..... 211/70.2, 70.8, 64, 68, 47, 198, 200, 211/195, 187, 70.3; 182/165, 152, 159; 108/99, 108/166, 178, 179

See application file for complete search history.

(56) References Cited

U.S. PATENT DOCUMENTS

| | | | | | |
|---|---|---|---|---|---|
| 1,104,004 | A | * | 7/1914 | Rathbone | 211/70.3 |
| 1,718,885 | A | * | 6/1929 | Williams | 182/121 |
| 1,934,937 | A | * | 11/1933 | Macdonald | 297/139 |
| 2,251,271 | A | * | 8/1941 | Del Campo, Jr. | 211/64 |
| 2,774,528 | A | * | 12/1956 | Crouse | 182/160 |
| D292,457 | S | * | 10/1987 | Hunter | D6/469 |
| 5,626,379 | A | * | 5/1997 | Scott | 294/143 |
| 6,792,880 | B2 | * | 9/2004 | Tsai | 108/115 |

* cited by examiner

*Primary Examiner* — Jonathan Liu
*Assistant Examiner* — James Twomey
(74) *Attorney, Agent, or Firm* — Wolfe-SBMC

(57) ABSTRACT

A collapsible equipment rack is described. In one or more implementations, a rack is comprised of a collapsible leg assembly and removable shelving that attaches to the collapsible leg assembly. The collapsible leg assembly is configured to form a supportive stand that supports the removable shelving, which extends away from the collapsible leg assembly and is configured to hold equipment upright. In one or more implementations, the removable shelving may be removed from the rack and the collapsible leg assembly may be folded into a closed position. In the closed position, legs of the collapsible leg assembly are drawn substantially together and are disposed substantially parallel, one leg to another.

19 Claims, 5 Drawing Sheets

COLLAPSIBLE EQUIPMENT RACK

RELATED APPLICATION

This application claims priority to U.S. Provisional Application Ser. No. 61/516,622 filed Apr. 4, 2011, entitled "3 Piece or 5 Piece Breakdown Rack" to Tammy L. Y. Tanabe, the disclosure of which is hereby incorporated by reference in its entirety.

BACKGROUND

Equipment may be stored or held in a variety of ways. For example, some equipment may be packed in boxes, other equipment may be carried in bags, while still other equipment may be hung on or even stood up against another object. Oftentimes, the apparatus used to store or hold equipment may be chosen based on the equipment itself as well as how a person handling the equipment decides to organize such equipment.

One apparatus that is commonly used to organize equipment is a rack. Conventional racks are typically designed to allow equipment to hang from the rack or to be placed up against or into the rack. However, many such racks are often also designed to be affixed to another structure or are large and awkward. Taking conventional racks to places where they could be used to hold equipment, therefore, may be undesirable.

SUMMARY

A collapsible equipment rack is described. In one or more implementations, a rack is comprised of a collapsible leg assembly and removable shelving that attaches to the collapsible leg assembly. The collapsible leg assembly is configured to form a supportive stand that supports the removable shelving, which extends away from the collapsible leg assembly and is configured to hold equipment upright.

In one or more implementations, the removable shelving may be removed from the rack, and the collapsible leg assembly may be folded into a closed position. In the closed position, legs of the collapsible leg assembly are drawn substantially together and are disposed substantially parallel, one leg to another.

In one or more implementations, the removable shelving comprises top shelves and bottom shelves. The bottom shelves may be attached to lower portions of the collapsible leg assembly to support base ends of equipment held upright by the rack. The top shelves may be attached to the collapsible leg assembly above the bottom shelves to stabilize the equipment at points away from the base ends. Additionally, the shelves may be notched to separate equipment held in one notch from equipment held in another notch. In still other implementations, shelves disposed on a front portion of the rack and shelves disposed on a rear portion of the rack may be notched to interleave equipment held by the shelves of the front portion with equipment held by shelves of the rear portion.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items. Entities represented in the figures may be indicative of one or more entities and thus reference may be made interchangeably to single or plural forms of the entities in the discussion.

DETAILED DESCRIPTION

Overview

Equipment may be stored or held in a variety of ways. For example, an equipment rack may be designed to allow equipment to hang from or rest up against a rack. Many conventional racks, however, are also affixed to another structure or are large and/or awkward. In many circumstances, removing a rack from a structure to which it is affixed may be tedious. In some cases, doing so may even damage the rack or the structure to which the rack is attached. Moving a large and/or awkward object may also be tedious due to the size and awkwardness. For example, a large object may not fit into a particular vehicle along with other items that are to be packed in the vehicle. One solution may be use a different (e.g., a larger) vehicle. Using a larger vehicle, however, may be impractical. For at least these reasons, many conventionally-designed racks are not taken to places where they could be useful for holding equipment.

A collapsible equipment rack is described that is configured to hold equipment. For example, the collapsible equipment rack may include a leg assembly that is configured, in an open position, to stand on a surface and to support shelving. The shelving may be configured to hold the equipment in a substantially upright manner. The shelving may be formed integral with the leg assembly or removable. Thus, when breaking down the equipment rack, the shelving may be removed from the collapsible leg assembly. From the open position, the leg assembly may be folded (e.g., collapsed) into a closed position for storage. In the closed position, legs of the collapsible leg assembly may be drawn together, such as drawn together in a "bundle". Accordingly, a user of the collapsible equipment rack may simply handle the bundled leg assembly and the removable shelves.

In the following discussion, a rack is described by way of example as holding equipment in an upright manner using more than one shelf. For instance, in many of the described examples one level of shelving is used so support a base end of the equipment while a second level is used to stabilize the equipment. However, it should be readily apparent that the following discussion is not limited to holding equipment in an upright manner using more than one shelf. Accordingly, a rack having a variety of shelving configurations and configured to hold a variety of equipment may employ the techniques described herein without departing from the spirit and scope thereof.

Example Rack

Figure 1:
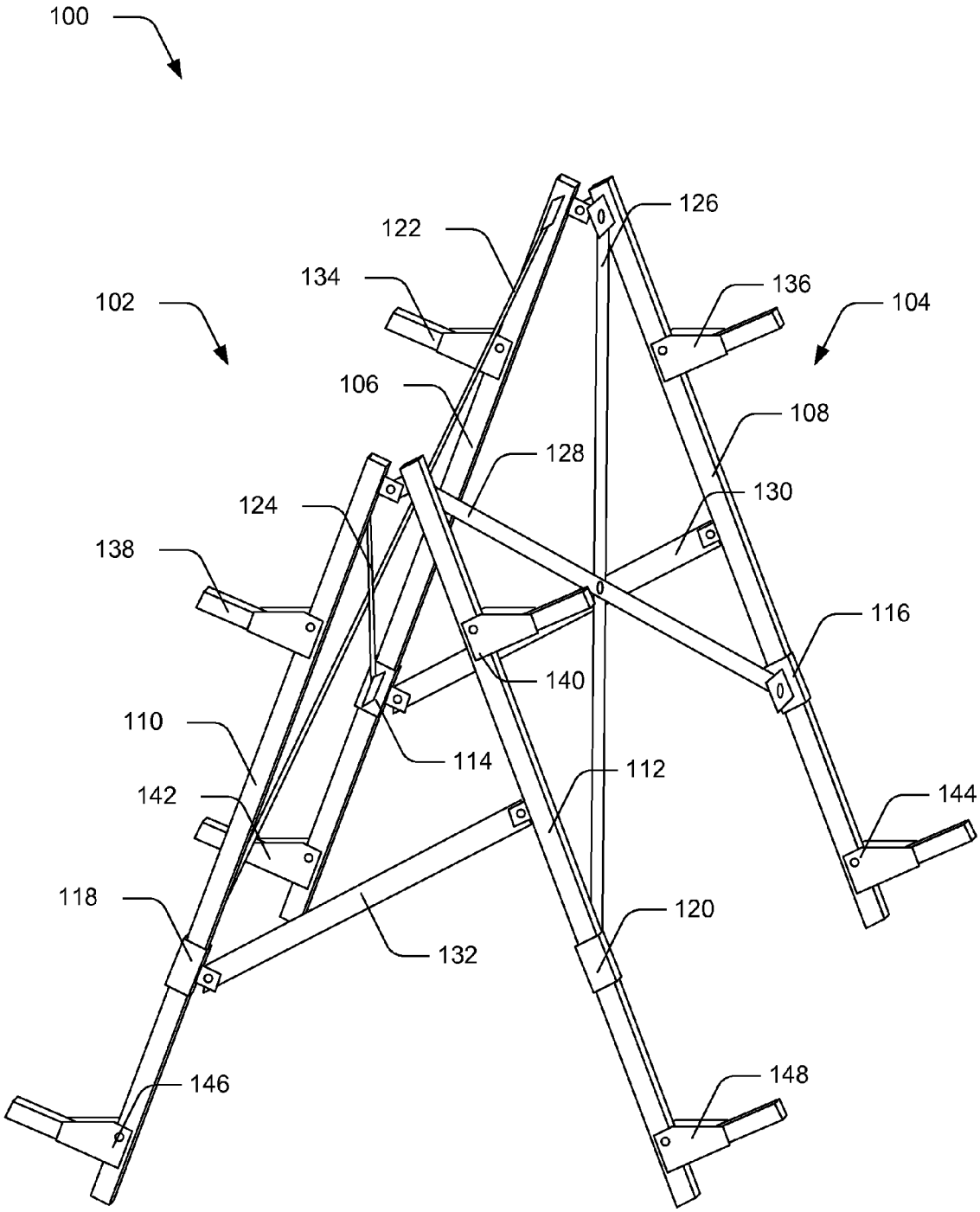
FIG. 1 is an illustration of a rack in an example implementation that is collapsible and is configured to form a supportive stand.

FIG. 1 is an illustration of rack 100 in an example implementation that is collapsible and is configured to form a supportive stand. The illustrated rack 100 comprises a collapsible leg assembly that includes a front portion 102 and a rear portion 104. The front and rear portions of the assembly include legs 106, 108, 110, 112. When facing the front portion of the collapsible leg assembly, legs 106, 108 correspond to left legs and legs 110, 112 correspond to right legs. The front and rear portions of the assembly also include slidable brackets 114, 116, 118, 120, that are slidably disposed on respective legs 106, 108, 110, 112 of the assembly. Slidable brackets 114, 116 may correspond to left slidable brackets and brackets 118, 120 may correspond to right slidable brackets (such as when facing the front portion of the collapsible leg assembly).

In the illustrated example, the collapsible leg assembly is shown in an open position, and in this position, is configured to form a supportive stand. As shown, the front portion 102 may be attached to the rear portion 104, such as at or near an apex of the collapsible leg assembly. For example, the left leg 106 of the front portion may be attached to left leg 108 of the rear portion, and right leg 110 of the front portion may be attached to right leg 112 of the rear portion. Further, the legs 106, 110 may be attached as described to respective legs 108, 112 at or near top portions of the legs. The attachment of the front portion 102 to the rear portion 104 may form a hinge between the front portion and the rear portion at the apex of the leg assembly.

The hinged attachment of the front portion 102 to the rear portion 104 enables the front and the rear portions to swing between a closed position and the open position. In the closed position, the front portion 102 is disposed substantially parallel to the rear portion 104, and accordingly, legs 106, 108, 110, 112 may be disposed substantially parallel one to another. From the closed position, the legs may be spread apart to the open position shown in FIG. 1. As shown, legs 106, 110 may meet legs 108, 112 at the apex of the leg assembly. From the apex of the leg assembly, however, the legs 106, 110 of the front portion 102 may diverge from the legs 108, 112 of the rear portion 104. In the open position, feet portions of legs 106, 110 are disposed apart from feet portions of legs 108, 112. When legs 106, 110 are spread apart from legs 108, 112 in this manner, the leg assembly may stand on a surface. In some implementations, a distance between the feet portions of left legs 106, 108 may be substantially the same as a distance between the feet portions of right legs 110, 112.

It should be noted that the collapsible equipment rack is not limited to a configuration in which the collapsible leg assembly has a front portion and a rear portion that are attached at an apex of the leg assembly (as shown in FIG. 1). Alternatively, for instance, the collapsible leg assembly may be three-sided or four-sided (or have more sides). In these configurations, when the collapsible leg assembly is in the open position, legs of the assembly may be disposed in positions that are substantially perpendicular to a surface on which the assembly stands. Nevertheless, in these alternative configurations, the rack may still be configured to collapse into a closed position, in which the pieces of the leg assembly are gathered together in a bundle.

In one or more implementations, rack 100 may be configured with a series of slidable brackets that are slidably disposed on legs of the collapsible leg assembly. For example, slidable brackets 114, 116, 118, 120 may each be slidably disposed on one of respective legs 106, 108, 110, 112. Slidable brackets 114, 116, 118, 120, for instance, may each be configured to slide up and down a respective leg 106, 108, 110, 112 in a direction that is substantially parallel to a longitudinal axis of the leg. Additionally, slidable brackets 114, 116, 118, 120 may include stoppers configured to keep each bracket from sliding along its respective leg. For example, stoppers may be used to keep the slidable brackets 114, 116, 118, 120 in particular positions along respective legs 106, 108, 110, 112, such as positions that correspond to the open position. In implementations, the stoppers may be releasable such that the slidable brackets 114, 116, 118, 120 are held in place when the stoppers are engaged but are able to slide up and down a respective leg when the stoppers are released.

In one or more implementations, the rack 100 may also be configured with crossbars. For example, the front portion 102 of the collapsible leg assembly may include crossbars 122, 124 and the rear portion may include crossbars 126, 128. The crossbars 122, 124, 126, 128 may be attached at one end to a leg of the collapsible leg assembly, and attached at an opposing end to a slidable bracket disposed on an opposing leg. For example, crossbar 122 of the front portion 102 may be pivotally attached at one end to the left leg 106 of the front portion, such as to a portion of the leg near the apex of the assembly. At the opposing end, crossbar 122 may be pivotally attached to the slidable bracket 118 on the right leg 110 of the front portion 102 (the slidable bracket is disposed at a position on the leg away from the apex). In a similar fashion, crossbar 124 of the front portion 102 may be pivotally attached at one end to the right leg 110 of the front portion, and attached at an opposing end to the slidable bracket 114 on the left leg 106 of the front portion. Thus, when facing the front portion 102, crossbars 122, 124 may appear to form an "X" that spans across the front portion. In some embodiments, the crossbars 122, 124 may be pivotally attached one to another, such where crossbar 122 crosses with crossbar 124 (e.g., the midpoints of crossbars 122, 124). Crossbars 126, 128 may be attached with the legs 108, 112 and the slidable brackets 116, 120 of the rear portion 104 in a similar way (i.e., crossbar 126 is pivotally attached to leg 108 at one end and to slidable bracket 120 at the opposing end, and crossbar 128 is pivotally attached to leg 112 at one end and to slidable bracket 116 at the other end).

In addition to having crossbars that span from a left side of the collapsible leg assembly to the right side of the assembly, rack 100 may be configured with side support crossbars. As shown in FIG. 1, the collapsible leg assembly includes side support crossbars 130, 132 that are attached at one end to the front portion 102 and at an opposing end to the rear portion 104. In the illustrated example, side support crossbar 130 corresponds to a left side support crossbar and side support crossbar 132 corresponds to a right side support crossbar (when facing front portion 102 of the collapsible leg assembly).

In this example, left side support crossbar 130 is pivotally attached at one end to the left leg 108 of the rear portion 104, and is pivotally attached at an opposing end to the slidable bracket 114 disposed on the left leg 106 of the front portion 102. Similarly, right side support crossbar 132 is pivotally attached at one end to the right leg 112 of the rear portion 104, and is pivotally attached at an opposing end to the slidable bracket 118 disposed on the right leg 110 of the front portion 102. Alternately, side support crossbars 130, 132 may be attached to the legs 106, 110 of the front portion and to the slidable brackets 116, 120 disposed on the legs 108, 112 of the rear portion 104.

In one or more implementations, rack 100 may be configured with support arm assemblies that fold down from the collapsible leg assembly and extend from the assembly to support shelving. For example, the collapsible leg assembly shown in FIG. 1 includes support arm assemblies 134, 136, 138, 140, 142, 144, 146, 148. In this example, the support arm assemblies 134, 136, 138, 140, 142, 144, 146, 148 are shown folded down from legs 106, 108, 110, 112 and in this position are configured to support removable shelving. Each support arm assembly comprises a bracket portion and a support arm portion. The bracket portion is integral with the support arm portion and is pivotally attached to a respective leg of the leg assembly. The bracket portion is attached to the respective leg such that the support arm assembly pivots substantially around an axis that runs through a point on a left side of the leg, through a point on the right side of the leg, and is substantially perpendicular to a longitudinal axis of the leg. The collapsible leg assembly may include more or fewer support arm assemblies than shown in FIG. 1, such as for various shelving configurations.

Figure 2:
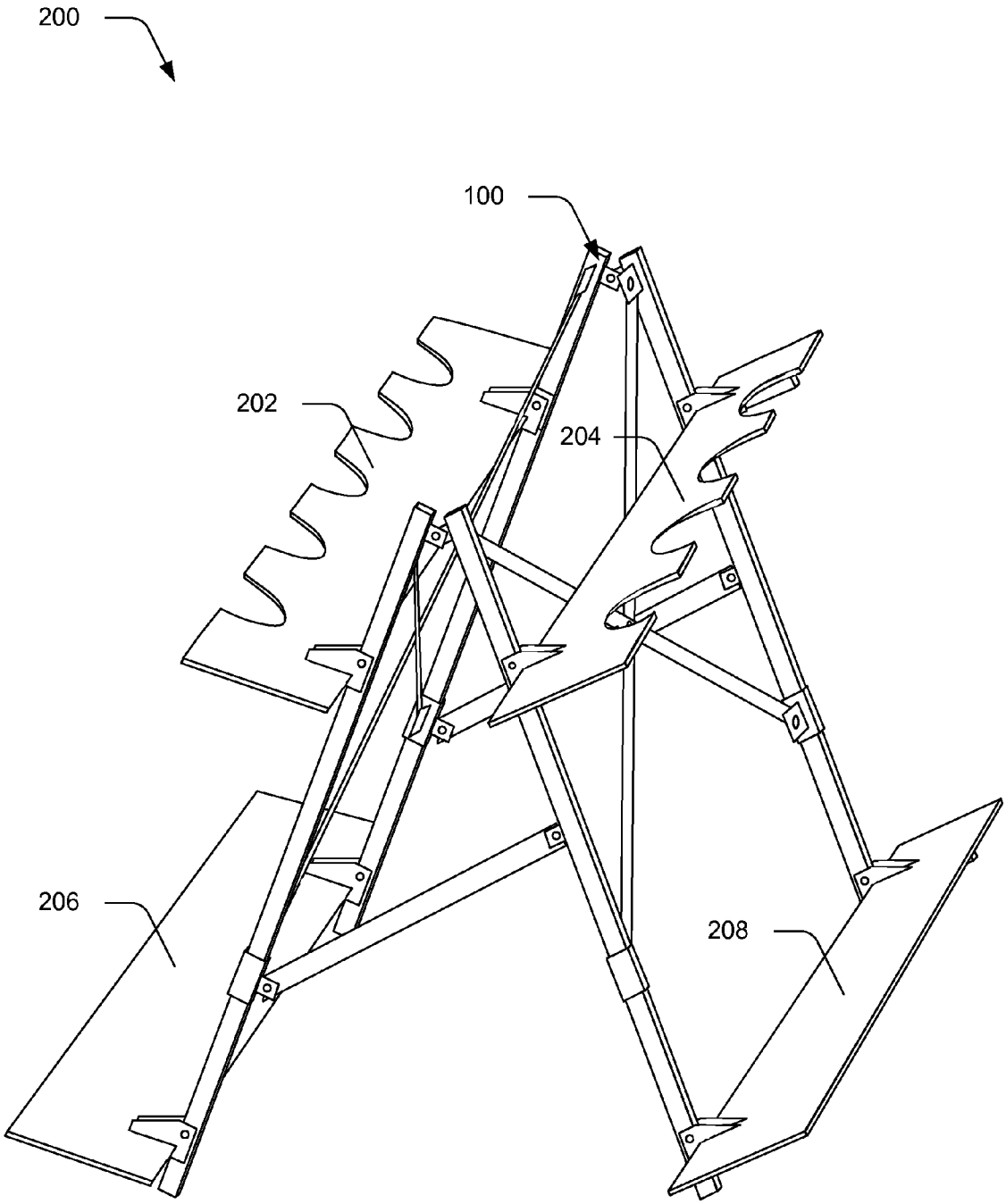
FIG. 2 is an illustration of a rack in an example implementation showing removable shelving attached to the rack that is configured to hold equipment upright.

FIG. 2 is an illustration of a rack 200 in an example implementation with removable shelving. For example, the rack 200 may correspond to rack 100 shown in FIG. 1, but including removable shelves 202, 204, 206, 208. As shown, the removable shelves 202, 204, 206, 208 may extend away from the collapsible leg assembly. The removable shelves 202, 204, 206, 208 may be supported by and may be attached to the collapsible leg assembly via support arm assemblies 134, 136, 138, 140, 142, 144, 146, 148. In the illustrated example, rack 200 includes shelves that are disposed on both the front portion 102 and the rear portion 104 of rack 100. In alternate embodiments, however, shelves may be disposed on a single one of the front portion 102 or the rear portion 104. For instance, the rack may include support arm assemblies on a front portion but not on a rear portion.

In one or more implementations, rack 200 may be configured with top shelves and bottom shelves. In FIG. 2, for example, rack 200 is shown with top shelves 202, 204 and bottom shelves 206, 208. The shelves may be configured to hold equipment placed on rack 200 in a substantially upright position. For instance, bottom shelves 206, 208 may be attached to lower portions of the leg assembly (e.g., to support arm assemblies 142, 144, 146, 148), and may be configured to support base ends of the equipment placed on the rack. Top shelves 202, 204, on the other hand, may be attached to the leg assembly above the bottom shelves (e.g., to support arm assemblies 134, 136, 138, 140), and may be configured to stabilize the equipment placed on the rack. The top shelves 202, 204, for instance, may stabilize the equipment supported by the bottom shelves 206, 208 at points along the equipment away from the base ends.

For example, if a gun, such as a rifle or a shotgun, is placed on rack 200, the bottom shelves 206, 208 may support a butt of the gun. In this example, the barrel of the gun may rest on and thus be stabilized by the top shelves 202, 204. It should be noted that a variety of equipment (in addition to guns) may be held substantially upright by rack 200, such as fishing poles, skis, ski poles, snowboards, baseball bats, golf clubs, umbrellas, and the like.

If for example, rack 100 or rack 200 may also be used as a barrier for the police or military, if multiple units are lined up for crowd control, etc.

Additionally, rack 200 may be configured with more than two levels of shelves. For example, rack 200 may include a third level of shelves that are similar to the top shelves 202, 204 and are configured to provide further stabilization of equipment placed on rack 200. Alternately, rack 200 may be configured with four levels of shelving and arranged with a first level of bottom shelves, a first level of top shelves disposed above the bottom shelves, a second level of bottom shelves disposed above the first level of top shelves, and a second level of top shelves disposed above the second level of bottom shelves. In this way, rack 200 may be configured with multiple layers of shelving to hold equipment upright. In such alternate embodiments, rack 200 may include more or fewer support arm assemblies, to support the configuration of removable shelves.

As indicated above, shelves 202, 204, 206, 208 attach to the collapsible leg assembly via the support arm assemblies. However, shelves 202, 204, 206, 208 are also removable from the leg assembly and may be removed from the rack 200 so that the rack can be folded and stored. Folding the collapsible equipment rack for storage (e.g., into the closed position) is described in more detail below with reference to FIGS. 3A-3D.

Figure 3A:
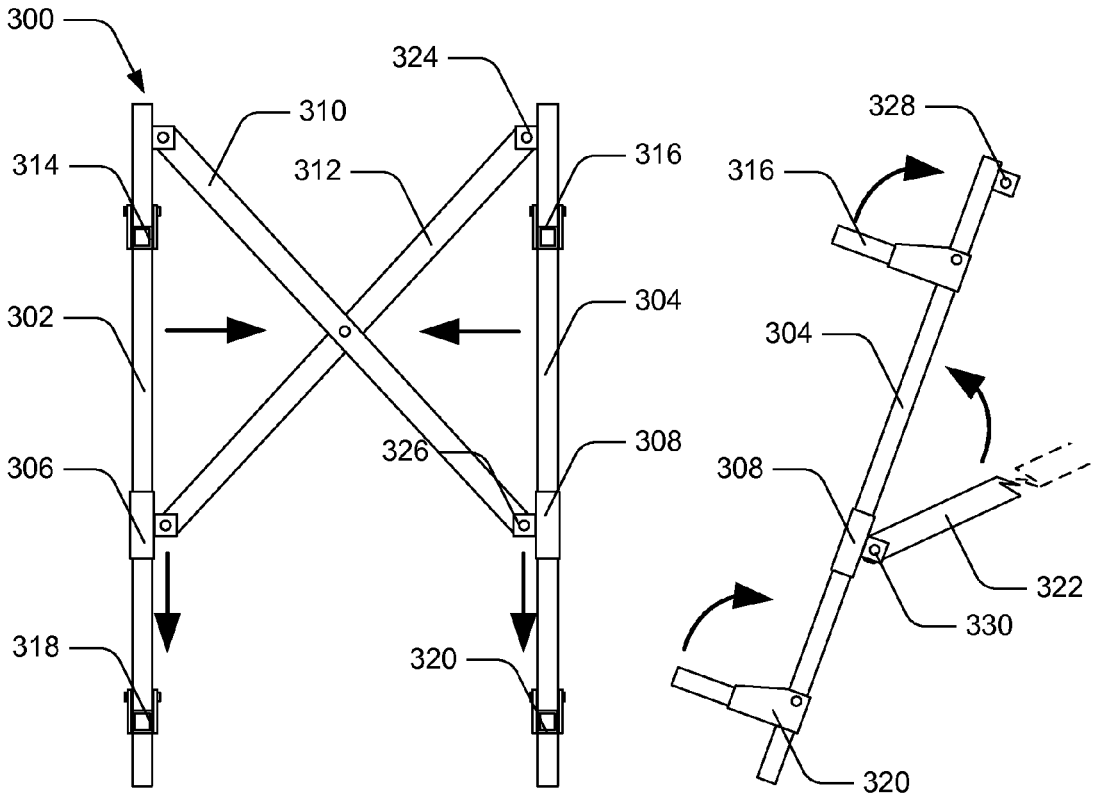
FIG. 3A is an illustration of a rack in an example implementation depicting a front portion of a leg assembly in an open position of the rack, which may be configured in accordance with one or more of the previously described racks of FIGS. 1 and 2.

FIG. 3A is an illustration of a rack 300 in an example implementation depicting a front portion of a leg assembly in an open position of the rack, which may be configured in accordance with one or more of the previously described racks of FIGS. 1 and 2. In FIG. 3A, both a view facing a front portion of rack 300 and a view facing a right side of the rack are shown. The depicted front portion of rack 300 may correspond to front portion 102 of FIG. 1. Thus, leg 302 may correspond to left leg 106 of the front portion 102 and leg 304 may correspond to leg 110 of the front portion. Similarly, slidable bracket 306 may correspond to slidable bracket 114, slidable bracket 308 may correspond to slidable bracket 118, crossbar 310 may correspond to crossbar 122, and crossbar 312 may correspond to crossbar 124.

Figure 3B:
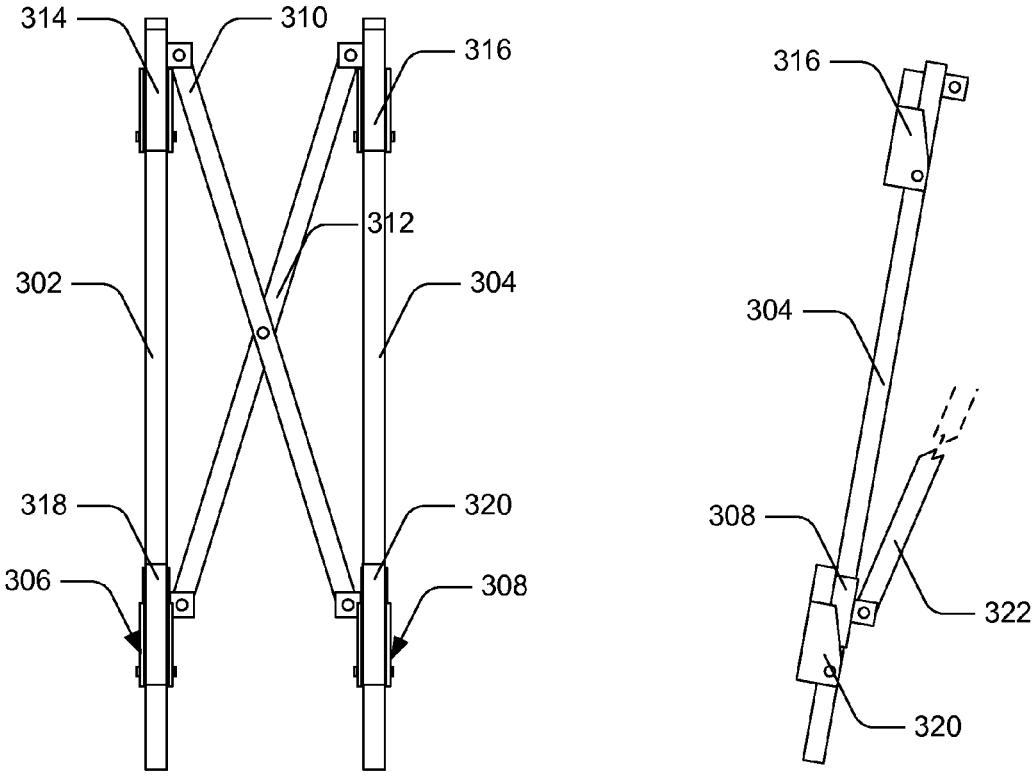
FIG. 3B is an illustration of the rack in an example implementation in which the front portion of the leg assembly is depicted in a partially collapsed position.

As discussed in more detail above, the slidable brackets 306, 308 may be configured to slide up and down legs 302, 304. From the open position (shown in FIG. 3A), slidable brackets 306, 308 may slide down legs 302, 304 to fold the leg assembly into the closed position. When the slidable brackets 306, 308 slide down legs 302, 304, the legs are drawn closer together, as shown in FIG. 3B. Conversely, when the slidable brackets 306, 308 slide up legs 302, 304 (such as from the closed position to the open position), the legs spread apart from one another.

Support arm assemblies are also shown in FIG. 3A. Support arm assemblies 314, 316, 318, 320 of rack 300 may correspond to support arm assemblies 134, 138, 142, 146 of FIG. 1. In FIG. 3A, support arm assemblies are shown folded down from legs 302, 304 (i.e., the legs to which the support arm assemblies are attached). When folded down, the support arm assemblies 314, 316, 318, 320 can support removable shelving. The right side view of rack 300 includes arrows that indicate how support arm assemblies 316, 320 may be pivoted upward to fold against leg 304. In this way, the collapsible leg assembly may be further folded for storage.

The right side view of rack 300 depicts a right side support crossbar 322, which may correspond to the right side support crossbar 132 of FIG. 1. As shown in FIG. 3A, the right side support crossbar 322 may be pivotally attached at one end to slidable bracket 308 of the depicted front portion. At the opposing end, the right side support crossbar 322 may be pivotally attached to a right leg of a rear portion. The right side view of rack 300 includes an arrow that indicates how the right side support crossbar 322 may pivot upward to fold against leg 304, such as when slidable bracket 308 slides down leg 304 toward the closed position.

Throughout the figures, the collapsible leg assemblies are shown with "tabs". For example, FIG. 3A includes tabs 324, 326, 328, 330. The tabs may extend directly from legs, such as tabs 324, 328 that extend from leg 304. Alternately or in addition, the tabs may extend from the slidable brackets, such as tabs 326, 330 that extend from bracket 308. The tabs of the collapsible leg assembly may be used where pieces of the collapsible leg assembly are pivotally attached. For example, tab 324 may be used for pivotally attaching crossbar 312 to leg 304. Similarly, tab 326 may be used for pivotally attaching crossbar 310 to slidable bracket 308, and tab 330 may be used for pivotally attaching right side support crossbar 322 to slidable bracket 308. Additionally, the tabs may be used to attach a front portion of a collapsible leg assembly to a rear portion at an apex of the assembly. Tab 328, for instance, may be used to attach the front portion depicted in FIGS. 3A and 3B to a rear portion, such as the rear portion depicted in FIGS. 3C and 3D. In this way, tab 328 may be used to form a hinge between the front portion and a rear portion.

FIG. 3B is an illustration of the rack 300 in an example implementation in which the front portion of the collapsible leg assembly is depicted in a partially collapsed position. In FIG. 3B, both a view facing the front portion of rack 300 and a view facing the right side of the rack are shown. In this example, legs 302, 304 are closer to each other than in FIG. 3A. In addition, the slidable brackets 306, 308 are disposed further down the legs 302, 304 (i.e., closer to the feet) in FIG. 3B than in FIG. 3A. In the view facing the front portion, slidable brackets 306, 308 are disposed behind support arm assemblies 318, 320. As such, only tabs that extend from the slidable brackets 306, 308 are shown in this view (e.g., where crossbars 310, 312 are pivotally attached to the slidable brackets). In this example, support arm assemblies 314, 316, 318, 320 are shown folded up against respective legs 302, 304 (i.e., in the closed position). In the right side view of FIG. 3B, right side support crossbar 322 is shown folded closer to leg 304. When the collapsible leg assembly is in the closed position, right side support crossbar 322 is disposed substantially parallel with leg 304.

Figure 3C:
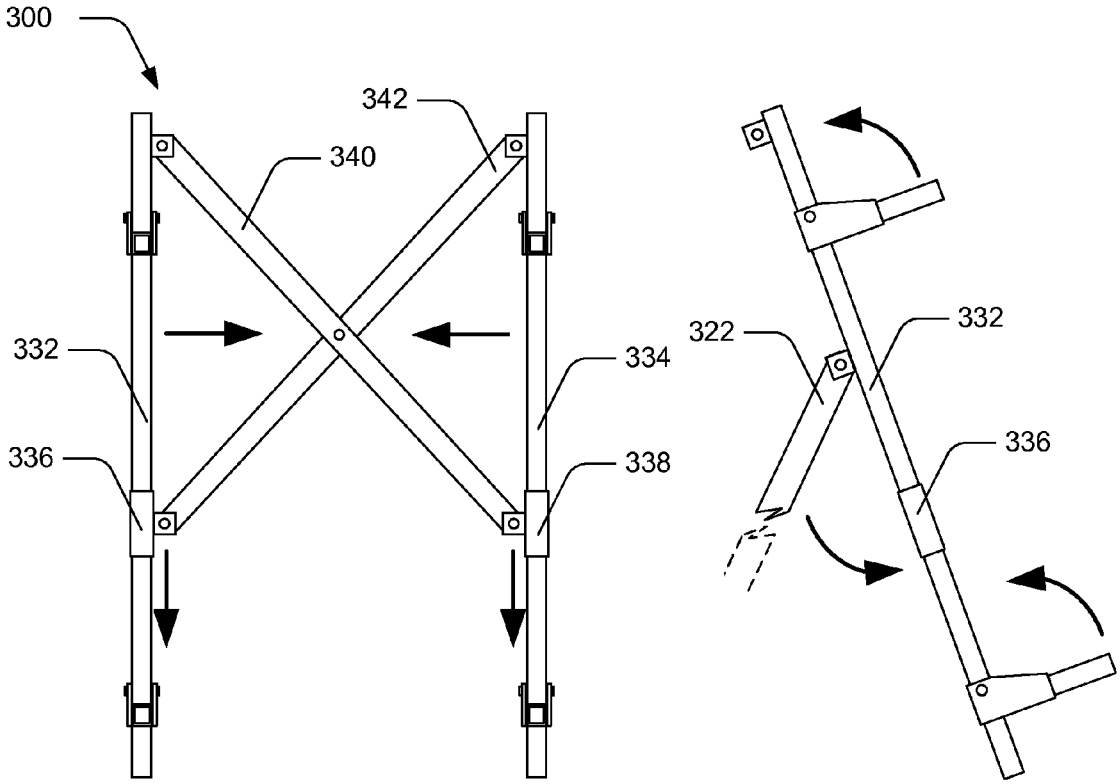
FIG. 3C is an illustration of the rack in an example implementation depicting a rear portion of the leg assembly in an open position.
Figure 3D:
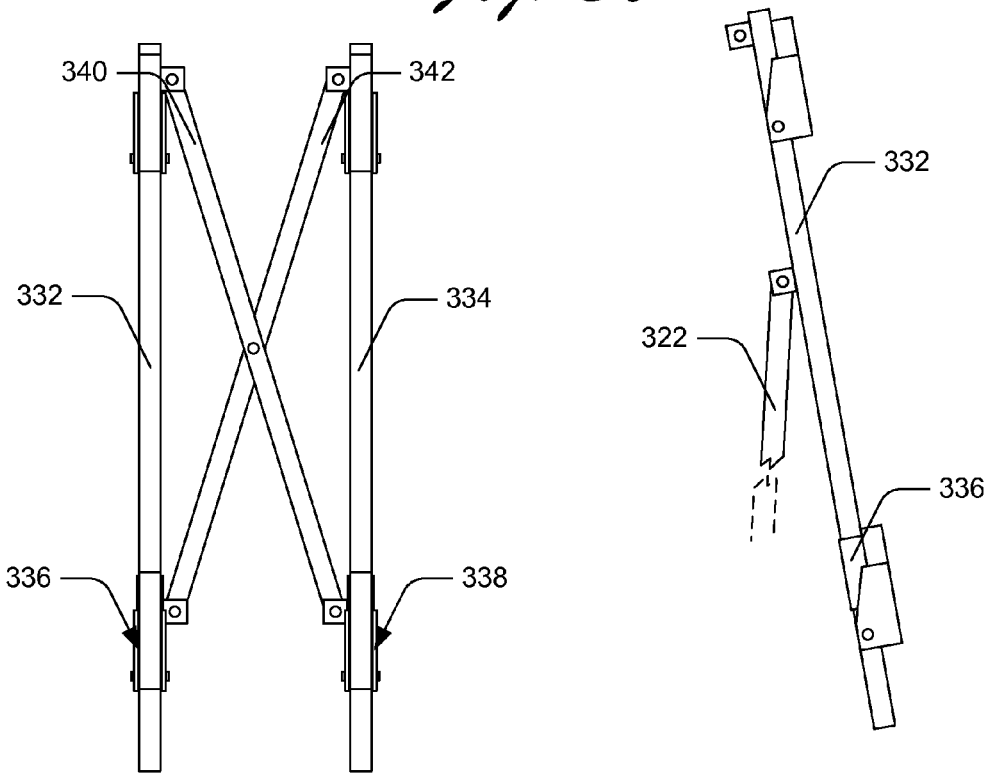
FIG. 3D is an illustration of the rack in an example implementation in which the rear portion of the leg assembly is depicted in a partially collapsed position.

FIG. 3C is an illustration of the rack 300 in an example implementation depicting a rear portion of the leg assembly in an open position. In FIGS. 3C and 3D, both a view facing the rear portion of rack 300 and a view facing the right side of the rack are shown. The depicted rear portion of rack 300 may correspond to rear portion 104 of FIG. 1. Thus, leg 332 may correspond to leg 112 of the rear portion 104 and leg 334 may correspond to leg 108 of the rear portion 104. Still further, slidable bracket 336 may correspond to slidable bracket 120, slidable bracket 338 may correspond to slidable bracket 116, crossbar 340 may correspond to crossbar 128, and crossbar 342 may correspond to crossbar 126.

Slidable brackets 336, 338 may be configured to slide up and down legs 332, 334. In FIG. 3C, the rack 300 is illustrated in the open position (i.e., legs 332, 334 are spread apart and slidable brackets 336, 338 are disposed at positions on the legs that correspond to the open position). By sliding brackets 336, 338 down legs 332, 334, the legs are drawn closer together.

FIG. 3D is an illustration of the rack 300 in an example implementation in which the rear portion of the collapsible leg assembly is depicted in a partially collapsed position. In this example, legs 332, 334 are closer to each other than in FIG. 3C. In addition, the slidable brackets 336, 338 are disposed further down the legs 332, 334 (i.e., closer to the feet) than in FIG. 3C.

Right side support crossbar 322 is also shown in FIGS. 3C and 3D. In the illustrated example, right side support crossbar 322 is pivotally attached at one end to leg 332. As discussed above, right side support crossbar 322 may be pivotally attached at an opposing end to a front portion, such as to the slidable bracket 308 shown in FIGS. 3A and 3B. The right side support crossbar may pivot downward to fold against leg 332, such as when rack 300 is folded into the closed position.

In the closed position, the legs, crossbars, and side support crossbars of the collapsible leg assembly are disposed substantially parallel one to another. Support arm assemblies, which are shown folded down from the leg assembly in FIG. 3C, fold up against the legs to which they are attached (as shown in FIG. 3D). Still further, the legs of the collapsible leg assembly are gathered substantially together when the rack is in the closed position. For example, the legs may be gathered into a bundle. In this way, the collapsible leg assembly may be conveniently stored, such as in a bag similar to those used to store folding lawn chairs.

Figure 4:
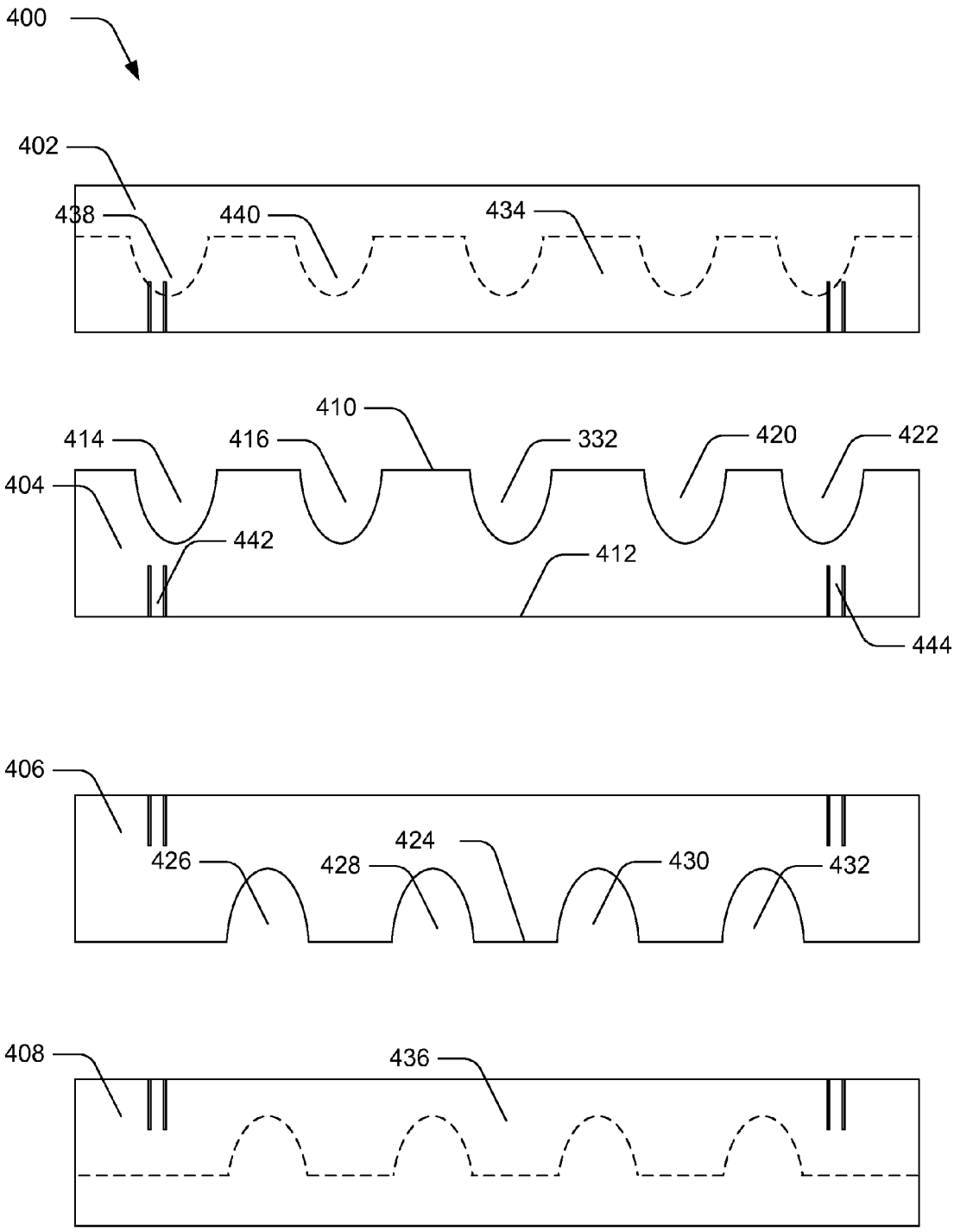
FIG. 4 is an illustration of shelving in an example implementation depicting top and bottom shelves, which may be removable from and/or attached to one or more of the previously described racks of FIGS. 1-3D.

FIG. 4 is an illustration of shelving 400 in an example implementation depicting top and bottom shelves, which may be removable from and/or attached to one or more of the previously described racks of FIGS. 1-3D. For example, shelves 402, 404, 406, 408 may be removable from and/or attached a collapsible leg assembly to hold equipment upright. Shelves 402, 404 may correspond to a set of shelves disposed on either a front portion or a rear portion of one such collapsible leg assembly. For example, shelves 402, 404 may be disposed on front portion 102 of rack 100. Accordingly, shelves 406, 408 may correspond to a set of shelves disposed on an opposing portion of the collapsible leg assembly. In the ongoing example, where shelves 402, 404 may be disposed on the front portion 102 of rack 100, shelves 406, 408 may be disposed on the rear portion 104 of the rack. In implementations, shelves 402, 408 may correspond to bottom shelves and shelves 404, 406 may correspond to top shelves.

In one or more implementations, shelves may be notched along an outward facing edge to separate equipment held by the rack. For example, shelf 404 may have an outward facing edge 410 and an inward facing edge 412. The edges may be described as "outward facing" and "inward facing" because when shelf 404 is attached to the collapsible leg assembly, the outward facing edge 410 may face away from the collapsible leg assembly and the inward facing edge 412 may be disposed against the collapsible leg assembly. In the illustrated example, the outward facing edge 410 of shelf 404 is notched, and includes notches 414, 416, 418, 420, 422. The notches 414, 416, 418, 420, 422 may be configured to separate equipment held upright by shelves 402, 404. For example, equipment that is disposed in notch 414 may be separated from equipment disposed in notch 416. Similarly, equipment disposed in notch 416 may be separated from equipment disposed in notch 418, and so on.

As shown in FIG. 4, an outward facing edge 424 of shelf 406 may also be notched (e.g., with notches 426, 428, 430, 432) to separate equipment held by the rack. The notches 426, 428, 430, 432 of shelf 406 may be disposed not only to separate equipment held upright by shelves 406, 408 (e.g., such that equipment disposed in notch 426 is separated from equipment disposed in notch 428, and so on), but may also be disposed to separate such equipment, from equipment held on shelves 402, 404. For example, the equipment held on shelves 402, 404 may be interleaved with the equipment held on shelves 406, 408. In this example, the equipment held by shelf 406 in notch 426 may be disposed between equipment held by shelf 404 in notches 414 and 416. In a similar fashion, equipment held by shelf 404 in notch 416 may be disposed between equipment held by shelf 406 in notches 426 and 428.

In some implementations, the bottom shelves 402, 408 may include notched portions 434, 436 (indicated by the dashed lines) attached to base portions of the shelves 402, 408. The notched portions 434, 436 may be raised relative to the base portions such that equipment may be supported by but separated on shelves 402, 408. In an example, base ends of equipment may be supported by shelf 402 and some of the equipment may be disposed in notch 438 of notched portion 434. In this example, base ends of some equipment may also be disposed in notch 440 of notched portion 434. In this way, the equipment having base ends disposed in notch 438 may be separated from equipment having base ends disposed in notch 440.

Although shelf 404 is configured with five notches and shelf 406 is configured with four notches in the illustrated example, the shelves may be configured with more or with fewer notches in different embodiments. For example, shelf 404 may be configured with eight notches and shelf 406 may be configured with seven notches. In a similar fashion, the notched portions 434, 436 of respective shelves 402, 408 may be configured with a different number of notches than shown in FIG. 4 (e.g., notched portion 434 may have eight notches and notched portion 436 may have seven notches).

The inward facing edges of the removable shelving may be notched to enable the shelves to be slidably integral with the support arm assemblies to which the shelves attach. The shelves in FIG. 4 are each shown having notches on an inward facing edge. For example, shelf 404 includes sets of notches 442, 444 notched along inward facing edge 412. As indicated previously, shelf 404 may be attached to front portion 102 of rack 100. For example, shelf 404 may be supported by and attached to support arm assemblies 134, 138 of the front portion 102. Support arm brackets (the portion that attaches the support arm assembly to a respective leg) of the support arm assemblies 134, 138 may slide into the sets of notches 442, 444 notched along the inward edge 412 of shelf 404. Accordingly, the removable shelving may be slidably integral with the support arm assemblies.

Conclusion

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. A gun rack comprising:

a collapsible leg assembly configured, in an open position, to form a supportive stand and comprises a front portion and a rear portion that each has a left and right leg and:

a left and right slidable bracket that are configured to slide along a respective said leg; and a first and second crossbar, each said crossbar is pivotally attached at an end to one said leg of a respective portion and pivotally attached at an opposing end to one said slidable bracket on an opposing said leg of a respective portion;

removable shelving, which is slidably integral with support arm assemblies that are pivotally attached to the collapsible leg assembly, the removable shelving:

is notched along inward facing edges and is slidably integral with the support arm assemblies such that portions of the support arm assemblies slide into the notches notched along the inward facing edges of the removable shelving; and comprises lower shelving and upper shelving having notched portions that are notched along outward facing edges of the shelving and is configured to hold one or more guns upright such that a butt of one said gun is disposed in an outward facing notch of the lower shelving and a barrel of the one said gun is disposed in an outward facing notch of the upper shelving.

2. A gun rack as described in claim 1, wherein the collapsible leg assembly is further configured to fold into a closed position such that:

the front portion of the collapsible leg assembly is drawn substantially together with the rear portion of the collapsible leg assembly; and the left legs of the front and rear portions are drawn substantially together with the right legs of the front and rear portions.

3. A gun rack as described in claim 1, wherein the front portion of the collapsible leg assembly is attached to the rear portion of the collapsible leg assembly forming a hinge at an apex of the collapsible leg assembly, wherein the front portion and the rear portion are configured to swing between:

a closed position, in which the front portion and the rear portion are disposed substantially parallel to each other; and the open position, in which feet of the front portion are positioned away from feet of the rear portion.

4. A gun rack as described in claim 1, wherein the the left and right slidable bracket are configured to slide along a respective said leg in a direction that is substantially parallel to a longitudinal axis of the respective said leg.

5. A gun rack as described in claim 1, wherein the collapsible leg assembly further comprises a left and right side support crossbar and wherein:

the left side support crossbar is pivotally attached at an end to the left leg of the rear portion and pivotally attached at an opposing end to the left slidable bracket of the front portion; and the right side support crossbar is pivotally attached at an end to the right leg of the rear portion and pivotally attached at an opposing end to the right slidable bracket of the front portion.

6. A gun rack as described in claim 1, wherein said legs of the collapsible leg assembly are configured to draw together as said slidable brackets slide down said legs and are configured to spread apart as said slidable brackets slide up said legs.

7. A gun rack as described in claim 1, further comprising stoppers that are configured to hold said slidable brackets at particular points along said legs to maintain the open position of the collapsible leg assembly.

8. A gun rack as described in claim 1, wherein the support arm assemblies are pivotally attached to said legs of the collapsible leg assembly and are configured to fold down from said legs to support the removable shelving.

9. A gun rack as described in claim 8, wherein each said support arm assembly pivots substantially around an axis that runs through a point on a left side of a respective said leg and a point on a right side of the respective said leg, wherein the axis is substantially perpendicular to a longitudinal axis of the respective said leg.

10. A gun rack comprising:

a leg assembly configured to form a supportive stand and comprising:

a front leg portion; and a rear leg portion that is attached to the front leg portion forming a hinge at an apex of the leg assembly;

the front leg portion and the rear leg portion including left and right legs, left and right slidable brackets configured to slide along a respective said leg, and first and second crossbars that each pivotally attach at an end to one said leg of a respective portion and pivotally attach at an opposing end to one said slidable bracket on an opposing leg of a respective portion; and removable shelves, which are notched along inward facing edges and are slidably integral with support arm assemblies that extend away from the leg assembly such that support arm brackets of the support arm assemblies slide into the notches notched along the inward facing edges of the removable shelves, the removable shelves are configured to hold one or more guns substantially upright.

11. A gun rack as described in claim 10, wherein the support arm assemblies are configured to fold down from the leg assembly to support the removable shelves.

12. A gun rack as described in claim 10, wherein the removable shelves comprise:

one or more bottom shelves, which attach to lower portions of the leg assembly and are configured to support base ends of the one or more guns; and one or more top shelves, which attach to the leg assembly above the one or more bottom shelves and are configured to stabilize the one or more guns at points along the one or more guns away from the base ends.

13. A gun rack as described in claim 10, wherein a top said removable shelf is notched along an outward facing edge and wherein notches notched along the outward facing edge of the top said shelf are configured to separate said guns disposed in one notch from said guns disposed in another notch.

14. A gun rack as described in claim 10, wherein a bottom said shelf comprises a notched portion that is integral with a base portion to support base ends of the one or more guns, wherein notches of the notched portion are configured to separate the base ends of said guns disposed in one notch from the base ends of said guns disposed in another notch.

15. A gun rack as described in claim 10, wherein at least one of the front leg portion or the rear leg portion is configured to support top said removable shelves and bottom said removable shelves.

16. A gun rack as described in claim 10, wherein both the front leg portion and the rear leg portion are configured to support top said removable shelves and bottom said removable shelves.

17. A gun rack as described in claim 10, wherein said removable shelves disposed on the front leg portion and said removable shelves disposed on the rear leg portion are notched along outward facing edges, and wherein notches notched along the outward facing edges are configured to interleave said guns held on said removable shelves of the front leg portion with said guns held on said removable shelves of the rear leg portion.

18. A gun rack comprising:

a leg assembly that is configured to expand from a closed position, in which legs of said assembly are drawn substantially together, to an open position, in which the legs are spread apart at a base of the leg assembly to form a supportive stand, the leg assembly comprising a front portion and a rear portion that each include:

a left and right leg;

a left and right slidable bracket that are each configured to slide along a respective said leg; and a first and second crossbar that are each pivotally attached at an end to one said leg of a respective portion and pivotally attached at an opposing end to one said slidable bracket on an opposing said leg of a respective portion; and a plurality of shelves that are notched along inward facing edges and are slidably integral with support arm assemblies that are pivotally attached to the leg assembly such that portions of the support arm assemblies slide into the notches notched along the inward facing edges of the plurality of shelves, the plurality of shelves configured to support base ends of one or more guns and stabilize the one or more guns at points along the one or more guns away from the base ends.

19. A gun rack as described in claim 18, wherein the plurality of shelves is configured to hold the one or more guns substantially upright.

* * * * *